US007003242B2

(12) United States Patent
Kida

(10) Patent No.: US 7,003,242 B2
(45) Date of Patent: Feb. 21, 2006

(54) IMAGE FORMING APPARATUS WITH COOLING SYSTEM

(75) Inventor: Hiroshi Kida, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/843,340

(22) Filed: May 12, 2004

(65) Prior Publication Data

US 2004/0228647 A1 Nov. 18, 2004

(30) Foreign Application Priority Data

May 13, 2003 (JP) ..... 2003-133833

(51) Int. Cl.
*G03G 21/20* (2006.01)

(52) U.S. Cl. ..... 399/92

(58) Field of Classification Search ..... 399/92, 399/118, 122, 124
See application file for complete search history.

(56) References Cited

U.S. PATENT DOCUMENTS 4,720,727 A * 1/1988 Yoshida ..... 399/93
2005/0025517 A1 * 2/2005 Ito ..... 399/92

FOREIGN PATENT DOCUMENTS

JP 60-197561 A 10/1985
JP 10-268735 A 10/1998
JP 2000-298422 A 10/2000
JP 2001236000 A * 8/2001
JP 2002040907 A * 2/2002

* cited by examiner

*Primary Examiner*—Quana Grainger
(74) *Attorney, Agent, or Firm*—Birch, Stewart, Kolasch & Birch, LLP

(57) ABSTRACT

An image forming apparatus has a first transport path for guiding a sheet of recording medium carrying a fixed image upward. There is a second transport path located above the first transport path. An exhaust device is above the second transport path, which can exhaust air located above the second transport path.

6 Claims, 3 Drawing Sheets

IMAGE FORMING APPARATUS WITH COOLING SYSTEM

CROSS REFERENCE

This nonprovisional application claims priority under 35 U.S.C. §119(a) on Patent Application No. 2003-133833 filed in Japan on May 13, 2003, the entire contents of which are hereby incorporated by reference.

BACKGROUND OF THE INVENTION

The present invention relates to an image forming apparatus provided with a fixing section for fixing an image formed on a sheet of recording medium in a preceding image forming process by application of heat to the sheet carrying the image.

In modern image forming apparatuses, such as copying machines, printers and facsimile machines, a loose (unfixed) image is first formed on a recording medium (e.g., a sheet of printing paper) and, then, heat is applied to the recording medium to fuse and fix the image to the recording medium. There is a growing demand these days to reduce mounting space of the image forming apparatus. To meet this demand, many image forming apparatuses developed in recent years are of a type in which an image formed of a developing agent, or toner, is transferred onto a sheet of recording medium and the transferred image is fused and fixed to the sheet by application of heat and pressure to the sheet carrying the unfixed image in a fixing section while the sheet is being fed in a sheet feeding direction upward from a sheet feeding section located at a lower part of the apparatus during an image forming process. Then, the sheet carrying the fixed image is redirected and transported generally in a horizontal direction opposite to the sheet feeding direction so that the sheet is discharged to the exterior of the apparatus or sent to an after-treatment unit, or recirculated through a sheet path for double-sided image forming if the apparatus has a duplex copying feature.

This type of image forming apparatus is usually provided with a document reading block (scanner unit) disposed at a topmost part of the apparatus for picking up image information from an original.

To prevent the sheet from deforming (e.g., curling) and toner particles from coming off the recording medium, the sheet should preferably be cooled after the aforementioned heat-assisted image fixing stage. The fixing section could reach high temperature which could potentially cause adverse influence on other parts of the apparatus. To overcome this heating problem, it is usually necessary to make provision for cooling surrounding areas of the fixing section.

There are known some conventional approaches to the resolution of the aforementioned problem. For example, Japanese Laid-open Patent Publication No. 2000-298422 discloses an image forming apparatus having a duct unit which forms an exhaust air channel disposed close to a fuser unit (fixing section) as well as a wall section which blocks flow of air from the fuser unit to the duct unit. This arrangement shown in Publication No. 2000-298422 is intended to prevent a temperature increase within the apparatus housing as a result of outflow of hot air from inside the fuser unit to an internal space of the housing.

Also, Japanese Laid-open Patent Publication Nos. H10-268735 and S60-197561 disclose image forming apparatuses of a type in which each sheet of recording medium is transported generally in a horizontal direction, and a temperature increase within the apparatus is avoided by exhausting air from around a fuser unit (fixing section) to the exterior through a duct or the like.

On the other hand, it is necessary to reduce power consumption of the fuser unit (fixing section) incorporating a relatively high-power heating device as much as possible to meet recent requirements for power savings.

In a case where the unfixed image is fused and fixed to the sheet by application of heat to the sheet of recording medium while the sheet is being transported upward as stated above, masses of hot air formed around the fixing section also ascend in the image forming process. Consequently, there arises a problem that the recording medium once heated in the fixing stage would not easily cool down.

Additionally, an image reading section is often located above the fixing section in the image forming apparatus of the aforementioned type in which the sheet of recording medium is fed upward and, therefore, the image forming apparatus has a problem that its image reading section is likely to reach an abnormally high temperature.

If the interior of the image forming apparatus is cooled by exhausting air masses from around (e.g., immediately above) the fixing section as shown in the aforementioned Patent Publication Nos. 2000-298422, H10-268735 and S60-197561, the fixing section itself is deprived of heat and, as a consequence, there arises a problem that the fixing section (or a heating device) requires an increased amount of power consumption to maintain a specific fixing temperature, despite the need to meet the requirements for power savings.

SUMMARY OF THE INVENTION

It is a feature of the invention to provide an image forming apparatus which makes it possible to aid in cooling a recording medium after a heat-assisted image fixing stage and prevent an increase in temperature of constituent parts of the apparatus other than a fixing section (in particular, an image reading section located above the fixing section) in a proper manner, yet ensuring that the fixing section is not deprived of heat as much as possible.

To achieve the feature, an image forming apparatus of the invention includes an image forming section for forming an image, a fixing section for fixing the image formed by the image forming section onto a sheet of recording medium by application of heat to the sheet carrying the image, a first transport path for guiding the sheet carrying the image fixed by the fixing section upward, a second transport path located above the fixing section for guiding the sheet which has passed through the first transport path generally in a horizontal direction, and an exhaust device located above the second transport path for exhausting air from a location above the second transport path.

In the image forming apparatus thus constructed, hot air masses ascending from around the fixing section are exhausted from the location above the second transport path, so that surrounding areas of the second transport path are cooled. As a consequence, the recording medium (e.g., a sheet of printing paper) transported through the second transport path is efficiently cooled. The second transport path and the sheet passing through the second transport path serve as a heat insulating layer because the second transport path is located between the exhaust device and the fixing section. Compared to the aforementioned conventional construction in which an exhaust duct is disposed in the vicinity of the fixing section to exhaust internal air masses, the construction of the present invention would not deprive the fixing section of an unnecessarily large amount of heat (or excessively cool the fixing section). Therefore, the construction of the invention would not cause any increase in power consumption of the fixing section (i.e., a heater thereof) for maintaining a specific fixing temperature.

In one embodiment of the invention, the exhaust device preferably includes a fan or the like for forcibly exhausting the air from the location above the second transport path to achieve improved cooling efficiency.

In another embodiment of the invention, the exhaust device includes an exhaust duct for drawing the air from the location above the second transport path to another location. This is preferable in efficiently exhausting internal hot air masses.

In still another embodiment of the invention, the image forming apparatus further includes an image reading section located above the second transport path for reading image information from an original, wherein the exhaust device exhausts a mass of air from between the second transport path and the image reading section. This construction serves to prevent the image reading section from reaching an abnormally high temperature. Preferably, the image forming apparatus further includes a support member sustaining the image reading section, the support member including an exhaust duct constituting part of the exhaust device. This construction makes it unnecessary to provide an extra space for installing the exhaust duct, allowing for efficient use of available space.

Generally, the aforementioned support member is often made of a metallic material shaped by sheet forming work. Should this be the case, surrounding parts of the support member (exhaust duct) might be heated due to leakage of hot air from inside the support member or heat transfer from the support member. In this circumstance, the support member may contain in its inner space an inside member for enhancing the degree of airtightness of the support member, and this inside member should preferably be made of a heat insulating material. This arrangement would serve to prevent heating of the surrounding parts of the support member due to leakage of hot air or heat transfer from the support member.

In yet another embodiment of the invention, the image forming apparatus further includes a heat insulation wall disposed between the fixing section and the second transport path. This arrangement would be effective in preventing undesirable cooling of the fixing section.

These and other features and advantages of the invention will become more apparent upon reading the following detailed description along with the accompanying drawings.

DESCRIPTION OF THE PREFERRED EMBODIMENTS

Figure 1:
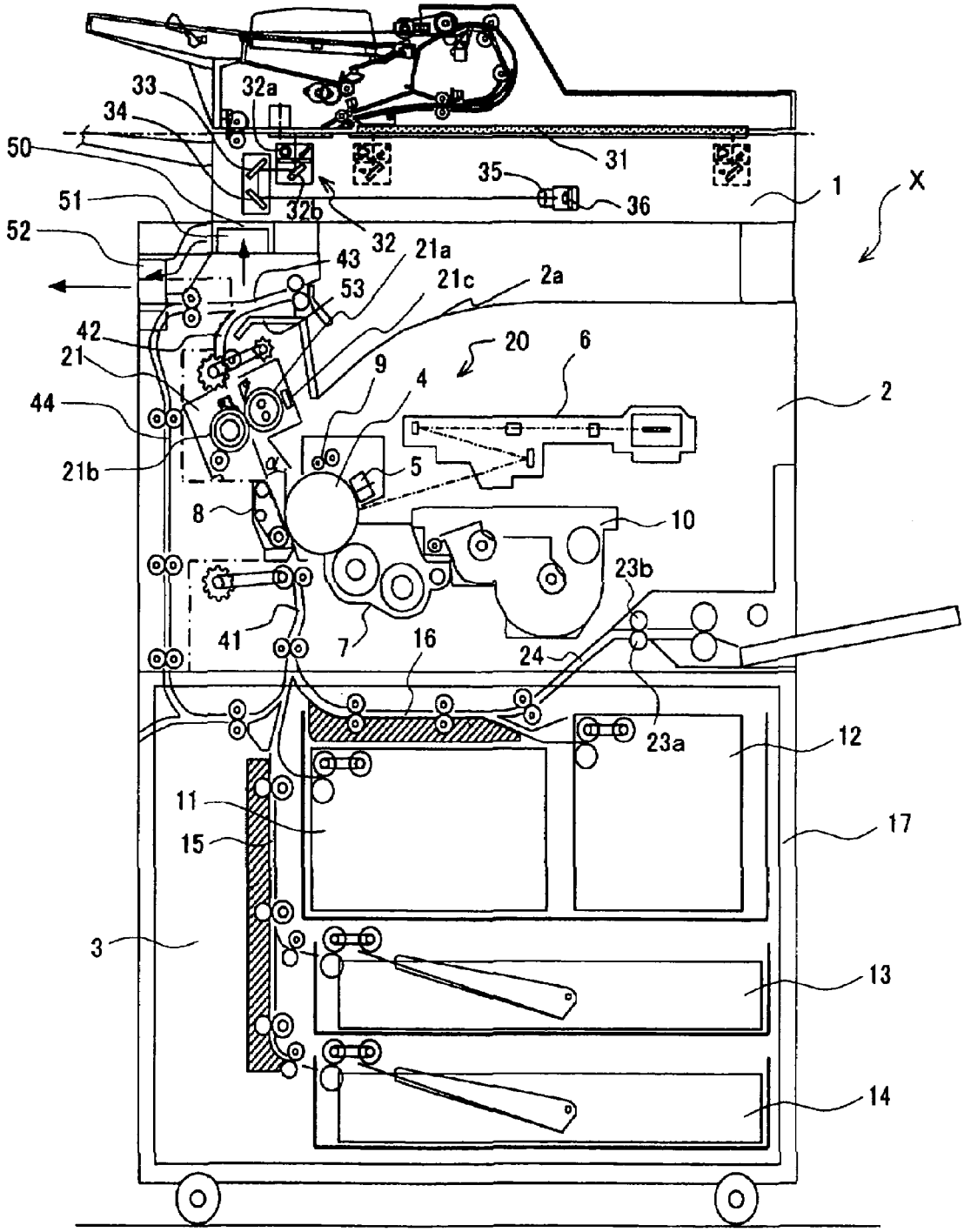
FIG. 1 is a general cross-sectional view of an image forming apparatus according to a preferred embodiment of the invention.

FIG. 1 is a general cross-sectional view of an image forming apparatus X according to a preferred embodiment of the invention.

Referring to FIG. 1, the image forming apparatus X is a hybrid machine featuring both copier and printer functions. The image forming apparatus X offers a plurality of printing modes, that is, copier mode, printer mode and facsimile mode. The image forming apparatus X has an unillustrated control unit which selects one of these printing modes according to an operator input through an operating terminal (not shown) or to a print job received from an external host equipment, such as a personal computer.

As can be seen from FIG. 1, the image forming apparatus X is roughly divided into a document reading block 1 located at a topmost part, a printer block 2 located below the document reading block 1 and a paper feed block 3 located below the printer block 2. When an operator presses a start key on an operator panel (not shown) which is located at the front of the exterior of the image forming apparatus X after entering various parameters, such as the number of copies and a printing scale factor, through parameter input keys on the operator panel, the image forming apparatus X begins to perform a copying sequence, whereby the document reading block 1 scans an original image placed on platen glass 31. At this point, a copy lamp 32*a* of a copy lamp unit 32 lights and the original is exposed to light projected from the copy lamp 32*a* of the copy lamp unit 32 which moves in a horizontal direction while the original is being scanned. Light emitted from the copy lamp 32*a* illuminates the original, Which reflects the incident light toward a first mirror 32*b* built in the copy lamp unit 32. The light reflected from the original containing original image information is redirected by the first mirror 32*b* and guided by a second mirror 33 and a third mirror 34. The reflected light is then focused by an optical lens 35 on a photosensitive surface of a charge-coupled device (CCD) 36. The document reading block 1 reads, or scans, the original image in this fashion. The "optical" image information thus obtained is converted into an electrical image information signal by a CCD circuit provided in the unillustrated control unit. This electrical image information signal is subjected to a specific image processing operation performed under previously set conditions and the processed image information is sent to an optical scan unit 6 provided in the printer block 2 as print data.

The printer block 2 includes an electrophotographic process assembly 20 which forms a toner image on a sheet of recording medium by means of a developing agent (toner) and a fuser unit 21 (fixing section) which applies heat and pressure to the sheet carrying the toner image to fuse and fix it to the sheet by passing the sheet between a fixing roller (heating roller) 21*a* and a pressure roller 21*b*. There is provided a heater inside the fixing roller 21*a*, and the electrophotographic process assembly 20 is provided with a temperature sensor 21*c* for detecting the temperature of the fixing roller 21*a*. Power supply to the heater is controlled by the unillustrated control unit in such a manner that the temperature of the fixing roller 21*a* detected by the temperature sensor 21*c* is maintained at a specific fixing temperature.

The electrophotographic process assembly 20 includes a photosensitive drum 4 disposed approximately at the middle of the electrophotographic process assembly 20, as well as a charger unit 5, the aforementioned optical scan unit 6, a developing unit 7, an image transfer unit 8 and a cleaning unit 9 which are arranged around the photosensitive drum 4 as illustrated. The charger unit 5 uniformly charges a cylindrical outer surface of the photosensitive drum 4, the optical scan unit 6 projects an optical image of the original onto the uniformly charged outer surface of the photosensitive drum 4 to produce a corresponding electrostatic latent image thereon, and the developing unit 7 converts the electrostatic latent image written on the outer surface of the photosensitive drum 4 into a visible toner image according to the print data. The image transfer unit 8 transfers the toner image reproduced on the photosensitive drum 4 onto the recording medium, such as a sheet of printing paper. The cleaning unit 9 removes particles of the developing agent (toner) left on the outer surface of the photosensitive drum 4 so that a new image can be formed on the photosensitive drum 4 in a succeeding image processing operation. The residual developing agent removed by the cleaning unit 9 is collected into a developing agent reservoir 10 for future (recycled) use.

It is to be noted in this connection that the present invention is not limited to the foregoing type of image forming apparatus featuring the aforementioned process of recycling the residual developing agent but is applicable to an image forming apparatus of a type in which the residual developing agent is just collected and abandoned. In the present embodiment, the paper feed block 3 incorporates four paper trays 11–14 so that the paper feed block 3 can store different types (e.g., sizes) of recording media, allowing for a wide variety of print jobs to be executed.

The paper trays 11 and 12 are arranged parallel to each other. The paper tray 13 is located below the paper trays 11 and 12 and the paper tray 14 is located below the paper tray 13 as illustrated in FIG. 1. The paper trays 13 and 14 have approximately the same sheet holding capacity with each other, whereas the sheet holding capacity of the paper trays 11 and 12 is made larger than that of the paper trays 13 and 14. The paper feed block 3 has a fourth transport path 15 and a fifth transport path 16 for transporting each sheet of recording medium stored in the paper trays 11–14 toward the printer block 2. Among them, the fourth transport path 15 is for transporting sheets from the paper trays 11, 13 and 14 to the printer block 2, and the fifth transport path 16 is for transporting sheets from the paper tray 12 to the printer block 2. The fourth transport path 15 extends generally upward in a vertical direction along a frame 17 of the paper feed block 3. On the other hand, the fifth transport path 16 extends generally in a horizontal direction along the frame 17. The paper trays 11–14 and the fourth and fifth transport paths 15, 16 are conveniently arranged inside the paper feed block 3, achieving thereby a space-saving design of the paper feed block 3.

When loading sheets of recording medium in any of the paper trays 11–14, the operator pulls it out toward the front of the image forming apparatus X and places the sheets.

When an image is to be formed on the recording medium in the image forming apparatus X thus constructed, one of the paper trays 11–14 selected and a sheet of recording medium separated from the underlying sheets is pulled out of the selected paper tray and transported upward toward the printer block 2. More specifically, the sheet supplied from one of the paper trays 11–14 is fed through the fourth or fifth transport path 15, 16 and transported further upward through a third transport path 41 up to a point the sheet is located between the photosensitive drum 4 and the image transfer unit 8. Then, the image transfer unit 8 transfers the aforementioned toner image reproduced on the photosensitive drum 4 onto the sheet supplied. The sheet carrying the toner image is transported upward to the fuser unit 21 located further above, where the fuser unit 21 fuses and fixes the toner image to the sheet by applying heat and pressure thereto. The sheet carrying the fixed toner image is sent from the fuser unit 21 into a first transport path 42 and guided further upward through a second transport path 43 located above the fuser unit 21. The second transport path 43 is a "switchback guide way" for redirecting the sheet carrying the fixed toner image fed through the first transport path 42 in an opposite horizontal direction. As a result, the sheet is discharged onto a delivery tray 2*a* located on the exterior of the image forming apparatus X or sent to an after-treatment unit (not shown), or sent back downward through a sixth transport path 44 for forming another image on a reverse side of the sheet (double-sided image forming).

Like the earlier-mentioned conventional image forming apparatus, the image forming apparatus X of the present embodiment is of a type in which the image is fixed while the sheet is being transferred upward. Since masses of hot air formed around the fuser unit 21 ascend together with the upward going sheet of recording medium, the sheet carrying the fixed toner image would not easily cool down. Furthermore, a stop position of the copy lamp unit 32 in the document reading block (image reading section) 1 is located above the first and second transport paths 42, 43, or above the fuser unit 21. Therefore, the masses of hot air ascending from around the fuser unit 21 are likely to produce an abnormally high-temperature which could cause a failure of the copy lamp unit 32. To cope with this problem, the image forming apparatus X of the embodiment is constructed such that the hot air masses accumulating above the second transport path 43 are forcibly exhausted by means of an exhaust duct 51 provided between the second transport path 43 and the aforementioned stop position of the copy lamp unit 32 in the document reading block 1.

More specifically, the air masses above the second transport path 43 are drawn from a lower opening of the exhaust duct 51, led toward a left side wall (as illustrated in FIG. 1) of the image forming apparatus X and, then, forcibly let out to the exterior by an exhaust fan 52 mounted in the left side wall of the image forming apparatus X. The exhaust duct 51 and the exhaust fan 52 together constitute an exhaust device of the image forming apparatus X. Since the hot air masses ascending from around the fuser unit 21 are exhausted through the exhaust duct 51 located above the second transport path 43 as stated above, surrounding areas of the second transport path 43 are cooled and, as a consequence, the sheet transported through the second transport path 43 is efficiently cooled.

In the aforementioned construction of the image forming apparatus X, the second transport path 43 and the sheet passing through the second transport path 43 serve as a heat insulating layer because the second transport path 43 is located between the exhaust duct 51 and the fuser unit 21. This construction serves to ensure that the fuser unit 21 would not be deprived of an unnecessarily large amount of heat, preventing thereby an increase in power consumption of the fuser unit 21 for maintaining the aforementioned fixing temperature. While the exhaust duct 51 of the present embodiment is intended to draw the hot air masses from above the printer block 2 to the exterior of the image forming apparatus X, the embodiment may be modified to allow for a further reduction in power consumption. For example, provision may be made to circulate the entirety or part of the hot air masses from above the second transport path 43 to the fuser unit 21 if only a space is available for making such provision. In this embodiment, the exhaust duct 51 is formed by a support member 50 supporting the document reading block 1.

Figure 2:
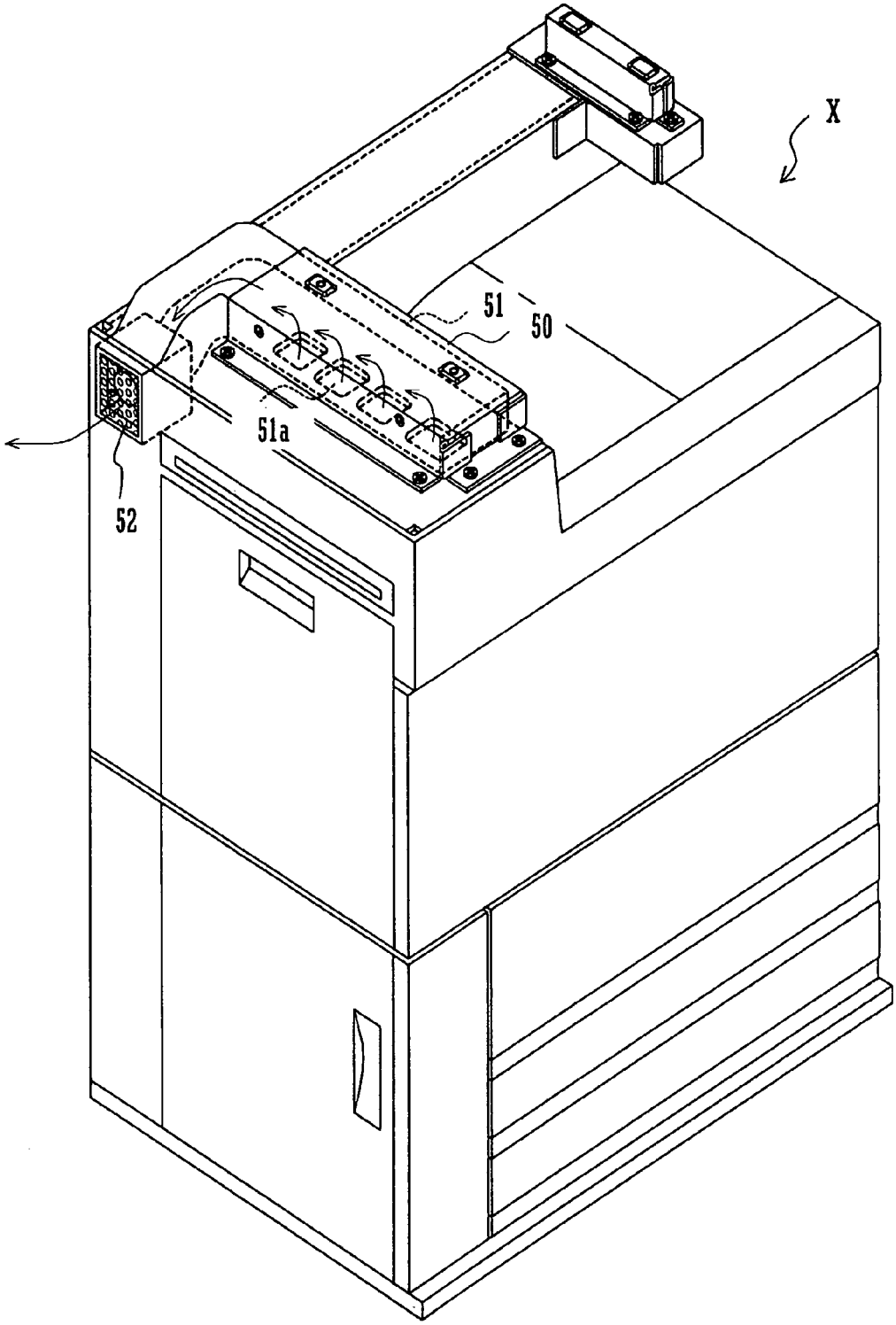
FIG. 2 is a perspective view of the image forming apparatus of the embodiment excluding a document reading block which is removed.

FIG. 2 is a perspective view of the image forming apparatus X excluding the document reading block 1 which is removed. Extending along a front-to-back direction of the image forming apparatus X, the exhaust duct 51 is formed in an inner space of the support member 50 which has a boxlike shape to support the document reading block 1 as shown in FIG. 2. There are formed a plurality of openings 51*a* in a bottom surface of the exhaust duct 51 almost over an entire extent of the fuser unit 21 and the second transport path 43 along the front-to-back direction of the image forming apparatus X, the openings 51*a* being located almost vertically above the fuser unit 21 and the second transport path 43. The hot air masses accumulating above the second transport path 43 are drawn through these openings 51*a* into the exhaust duct 51 and exhausted to the exterior of the image forming apparatus X by the exhaust fan 52. The exhaust fan 52 need not necessarily be located in the side wall of the image forming apparatus X directly facing the exterior, but may be located inside the exhaust duct 51 itself. The exhaust fan 52 is controlled to an appropriate turning speed according to operating conditions of the image forming apparatus X by the unillustrated control unit. Specifically, the turning speed of the exhaust fan 52 is increased to provide enhanced cooling performance (exhaust air volume) during a period of time when the image processing operation is in progress including some short periods preceding and following the actual period of the image processing operation. On the other hand, the turning speed of the exhaust fan 52 is decreased to lower power consumption and operating noise while the image forming apparatus X is at standby. In addition, there are formed openings in a sheet guide member of the second transport path 43 to ensure smooth flow of air into the exhaust duct 51.

A great effort is needed in the manufacture to form the exhaust duct 51 by increasing the degree of airtightness of the support member 50 itself. In addition, the support member 50 is made of a metallic material having poor heat insulating properties, so that heat is transmitted from the support member 50 to the document reading block 1 located above even if hot air masses are exhausted by means of the exhaust fan 52. Under these circumstances, the support member 50 contains in its inner space an inside member (not shown) made of a heat insulating material for enhancing the degree of airtightness of the support member 50 so that the exhaust duct 51 has a double-wall structure formed of the support member 50 itself and the inside member in the image forming apparatus X of this embodiment. This structure makes it possible to prevent heating of surrounding parts of the exhaust duct 51 due to leakage of hot air drawn into the exhaust duct 51 or heat transfer from the exhaust duct 51 itself even if the support member 50 itself has a low degree of airtightness.

Candidates for the heat insulating material used for the inside member of the support member 50 include resin materials having heat insulating properties, such as glass-filled polyethylene terephthalate (PET) and polybutylene terephthalate (PBT). In a case where the inside member is made of such a resin material, the degree of heat insulation can be regulated by selecting an appropriate type and thickness of the resin material, for example, and the inside member can be produced by injection molding, for example. Also, if it is possible to prevent an increase in temperature of the support member 50 due to a high displacement capacity of the exhaust fan 52, for instance, a thin sheet member (e.g., PET) may be used instead of the heat insulating material for enhancing the airtightness by filling holes and gaps formed in the support member 50 in sheet forming work. Needless to say, the degree of airtightness of the support member 50 itself may be increased so that the support member 50 can be used as the exhaust duct 51 without any additional provision.

The image forming apparatus X is further provided with a heat insulation wall 53 formed between the fuser unit 21 and the second transport path 43, covering almost entire surfaces of the fuser unit 21 as viewed from top, as can be seen from FIG. 1. The provision of the heat insulation wall 53 serves to further ensure that the fuser unit 21 would not be deprived of an unnecessarily large amount of heat and that the second transport path 43, the sheet being transported and individual elements located above the second transport path 43 would not be heated by the hot air masses ascending from around the fuser unit 21. Moreover, the image forming apparatus X has a structure for exhausting internal air to the exterior by means of an unillustrated fan and exhaust passage to prevent an abnormal increase in temperature inside the image forming apparatus X in addition to the aforementioned facilities. The turning speed of this additional fan is controlled based on a measurement result of an unillustrated thermometer for detecting the inside temperature of the image forming apparatus X so that the power consumption of the fuser unit 21 would not increase due to an excessive decrease in the inside temperature of the image forming apparatus X. More specifically, the fan is controlled such that its turning speed is decreased or zeroed when the inside temperature of the image forming apparatus X is low, increases when the inside temperature of the image forming apparatus X is high.

While the image forming apparatus X of the foregoing embodiment is constructed such that the exhaust duct 51 is formed in the inner space of the support member 50 supporting the document reading block 1, the invention is not limited to this construction but an exhaust duct may be provided independently of the support member 50.

Figure 3:
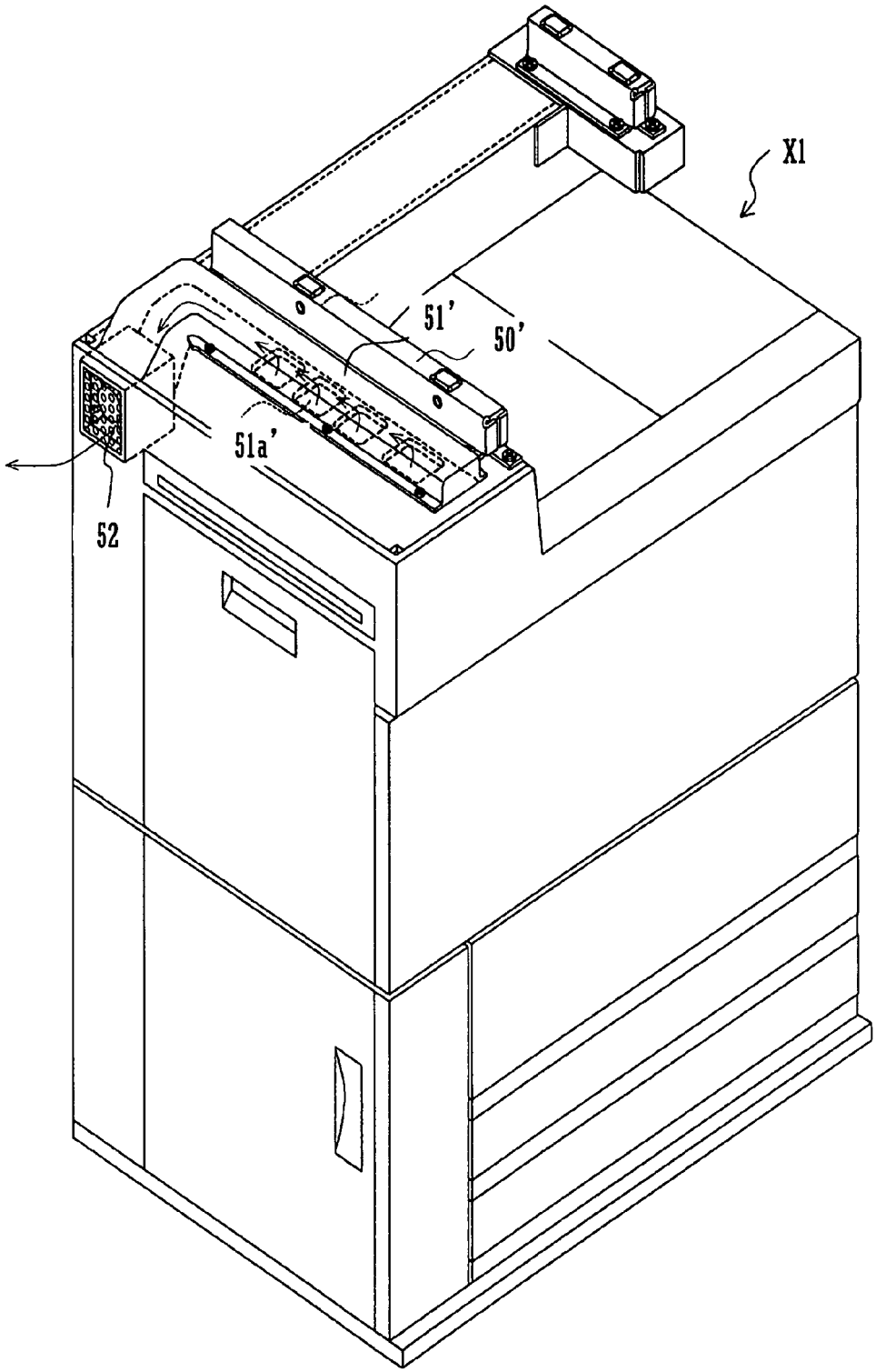
FIG. 3 is a perspective view of an image forming apparatus in one alternative of the embodiment of FIG. 1 excluding the document reading block which is removed.

FIG. 3 is a perspective view of an image forming apparatus X1 in one alternative of the foregoing embodiment employing such a modified form of exhaust duct structure.

While having generally the same construction as the image forming apparatus X of the aforementioned embodiment, the image forming apparatus X1 of the alternative differs from the image forming apparatus X in that a support member 50' supporting the document reading block 1 and an exhaust duct 51' for exhausting hot air masses from above the second transport path 43 are provided separately from each other. A member forming an outer shape of the exhaust duct 51' is made of a resin material having heat insulating properties and mounted as a separate piece from the support member 50'. The exhaust duct 51' has openings 51*a'* formed in a bottom surface at the same locations as in the exhaust duct 51 of the aforementioned embodiment. The exhaust duct 51' of this alternative has otherwise the same structure as the exhaust duct 51 of the aforementioned embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the invention.

What is claimed is:

1. An image forming apparatus comprising:

an image forming section for forming an image;

a fixing section for fixing the image formed by the image forming section onto a sheet of recording medium by application of heat to the sheet carrying the image;

a first transport path for guiding the sheet carrying the image fixed by the fixing section upward;

a second transport path located above the fixing section for guiding the sheet which has passed through the first transport path generally in a horizontal direction;

an exhaust device located above the second transport path for exhausting air from a location above the second transport path;

the image forming apparatus further comprising an image reading section located above the second transport path for reading image information from an original, wherein the exhaust device exhausts a mass of air from between the second transport path and the image reading section; and a box shaped support member sustaining the image reading section, the support member including an exhaust duct constituting part of the exhaust device.

2. The image forming apparatus according to claim 1, wherein the exhaust device includes a fan for forcibly exhausting the air from the location above the second transport path.

3. The image forming apparatus according to claim 1, wherein the exhaust device includes an exhaust duct for drawing the air from the location above the second transport path to another location.

4. The image forming apparatus according to claim 1, wherein the box shaped support member contains an inner space, and a layer for enhancing the degree of airtightness of the support member.

5. The image forming apparatus according to claim 4, wherein the layer comprises a heat insulating material.

6. The image forming apparatus according to claim 1 further comprising a heat insulation wall disposed between the fixing section and the second transport path.

* * * * *